US012650242B2

(12) United States Patent
Hakuta et al.

(10) Patent No.: US 12,650,242 B2
(45) Date of Patent: Jun. 9, 2026

(54) AIR PASSAGE TYPE SILENCER

(71) Applicant: FUJIFILM Corporation, Tokyo (JP)

(72) Inventors: Shinya Hakuta, Ashigarakami-gun (JP); Shogo Yamazoe, Ashigarakami-gun (JP); Yoshihiro Sugawara, Ashigarakami-gun (JP); Yuichiro Itai, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 218 days.

(21) Appl. No.: 18/626,454

(22) Filed: Apr. 4, 2024

(65) Prior Publication Data

US 2024/0280290 A1 Aug. 22, 2024

Related U.S. Application Data

(63) Continuation of application No. PCT/JP2022/035047, filed on Sep. 21, 2022.

(30) Foreign Application Priority Data

Oct. 29, 2021 (JP) ..... 2021-177346

(51) Int. Cl.
*F24F 13/24* (2006.01)
*F24F 13/02* (2006.01)

(52) U.S. Cl.
CPC ..... *F24F 13/24* (2013.01); *F24F 13/02* (2013.01)

(58) Field of Classification Search
CPC ..... F24F 13/24; F24F 13/02
(Continued)

(56) References Cited

U.S. PATENT DOCUMENTS 5,783,780 A * 7/1998 Watanabe ..... F02M 35/1261 181/252
6,386,317 B1 * 5/2002 Morohoshi ..... F02M 35/1266 181/252

(Continued)

FOREIGN PATENT DOCUMENTS

EP 0 412 315 B1 10/1996
JP 55-100019 U 7/1980

(Continued)

OTHER PUBLICATIONS

Extended European Search Report for corresponding European Application No. 22886528.3, dated Mar. 28, 2025.

(Continued)

*Primary Examiner* — Forrest M Phillips
(74) *Attorney, Agent, or Firm* — Birch, Stewart, Kolasch & Birch, LLP

(57) ABSTRACT

Provided is an air passage type silencer that can reduce pressure loss even in a case where the flow rate of a gas flowing in the air passage type silencer is high. An air passage type silencer includes an inlet-side ventilation pipe, an expansion portion that communicates with the inlet-side ventilation pipe and of which a cross-sectional area is larger than a cross-sectional area of the inlet-side ventilation pipe, and an outlet-side ventilation pipe that communicates with the expansion portion and of which a cross-sectional area is smaller than the cross-sectional area of the expansion portion. A level difference d satisfies Equation (1): $d \geq 100$ μm, satisfies Equation (2): $d \leq 25 \times Sa + 193$ μm in a case where an arithmetic average height Sa is equal to or smaller than 50 μm, and satisfies Equation (3): $d \leq 1450$ μm in a case where the arithmetic average height Sa exceeds 50 μm, where Sa (μm) is an arithmetic average height of a surface on a central side in the expansion portion and d (μm) is an average value of level differences between a ventilation pipe interior wall (Continued)

and the surface on the central side at at least one of a connection portion between the expansion portion and the inlet-side ventilation pipe or a connection portion between the expansion portion and the outlet-side ventilation pipe.

16 Claims, 6 Drawing Sheets

(58) Field of Classification Search
USPC ..... 181/175, 224, 212
See application file for complete search history.

(56) References Cited

U.S. PATENT DOCUMENTS 6,880,670 B2 * 4/2005 Dondi ..... B26D 7/018 181/269
8,393,436 B2 * 3/2013 Tomerlin ..... F01N 1/24 138/129
8,408,357 B2 * 4/2013 Cheung ..... F02M 35/1266 123/184.55
9,605,631 B2 * 3/2017 Zirkelbach ..... F02M 35/1216
11,156,150 B2 * 10/2021 Kimura ..... F02M 35/108

FOREIGN PATENT DOCUMENTS

JP 63-38325 Y2 10/1988
JP 2007-321735 A 12/2007
JP 2019-56516 A 4/2019

OTHER PUBLICATIONS

International Preliminary Report on Patentability and Written Opinion of the International Searching Authority (Forms PCT/IB/326, PCT/IB/373, and PCT/ISA/237) for International Application No. PCT/JP2022/035047, dated May 10, 2024, with an English translation.
International Search Report (Form PCT/ISA/210) for International Application No. PCT/JP2022/035047, dated Nov. 8, 2022, with an English translation.

* cited by examiner

AIR PASSAGE TYPE SILENCER

CROSS-REFERENCE TO RELATED APPLICATIONS

This application is a Continuation of PCT International Application No. PCT/JP2022/035047 filed on Sep. 21, 2022, which claims priority under 35 U.S.C. § 119(a) to Japanese Patent Application No. 2021-177346 filed on Oct. 29, 2021. The above applications are hereby expressly incorporated by reference, in their entirety, into the present application.

BACKGROUND OF THE INVENTION

1. Field of the Invention

The present invention relates to an air passage type silencer.

2. Description of the Related Art

As a silencer that attenuates a noise from a gas supply source or the like at a ventilation path intermediate position of a ventilation pipe through which a gas is transported, an air passage type silencer that is installed at the ventilation path intermediate position and that includes an expansion portion of which the cross-sectional area is larger than that of the ventilation pipe is known. In addition, there is a case where a porous sound absorbing material is disposed in an expansion portion so that the sound attenuation performance is improved. In the air passage type silencer, the porous sound absorbing material is disposed in a tubular shape so that a space serving as an air passage path is provided at a central portion.

For example, described as a discharge gas silencing device in JP1988-38325Y (JP-S63-38325Y) is a discharge gas silencing device in which a discharge gas inlet pipe and a discharge gas outlet pipe are respectively connected to a front end portion and a rear end portion of a housing of the silencing device, a tubular porous sound absorbing body accommodated in the housing is provided, and the discharge gas inlet pipe and the discharge gas outlet pipe are linearly connected to each other with the porous sound absorbing body serving as a sound absorption discharge gas path.

SUMMARY OF THE INVENTION

Regarding an air passage type silencer including an expansion portion, in a case where air (a gas) flows into the expansion portion through an inlet-side ventilation pipe and a case where air (a gas) flows out from the expansion portion through an outlet-side ventilation pipe, the air passes through a level difference between a ventilation pipe and the expansion portion. Therefore, pressure loss occurs and there is a problem that there is a decrease in amount of wind and pressure. Generally, the higher a flow rate is, the larger the degree of pressure loss is. Therefore, the higher the flow rate of a gas flowing in the air passage type silencer is, the more the pressure loss needs to be suppressed.

Therefore, in the case of a configuration in which a porous sound absorbing material is disposed in the expansion portion, it is conceivable that pressure loss can be suppressed in a case where the diameter of the inside of the porous sound absorbing material having a tubular shape and the diameters of the ventilation pipes are made equal to each other so that there is no level difference.

However, according to the study of the present inventors, it has been found that pressure loss in a configuration in which there is no level difference with respect to the ventilation pipes is larger than pressure loss in a configuration in which there is a level difference in a case where the flow rate of a gas flowing in the air passage type silencer is high in a case where a surface roughness is high as in the case of a porous sound absorbing material of which a surface is uneven since the porous sound absorbing material includes a large number of fine cavities.

An object of the present invention is to provide an air passage type silencer that can reduce pressure loss even in a case where the flow rate of a gas flowing in the air passage type silencer is high while solving the above-described problem of the related art.

In order to solve the above-described problem, the present invention has the following configurations.

[1] An air passage type silencer including:

an inlet-side ventilation pipe;

an expansion portion that communicates with the inlet-side ventilation pipe and of which a cross-sectional area is larger than a cross-sectional area of the inlet-side ventilation pipe; and an outlet-side ventilation pipe that communicates with the expansion portion and of which a cross-sectional area is smaller than the cross-sectional area of the expansion portion, in which a level difference d satisfies Equation (1): $d \geq 100$ μm, satisfies Equation (2): $d \leq 25 \times Sa + 193$ μm in a case where an arithmetic average height Sa is equal to or smaller than 50 μm, and satisfies Equation (3): $d \leq 1450$ μm in a case where the arithmetic average height Sa exceeds 50 μm, where Sa (μm) is an arithmetic average height of a surface on a central side in the expansion portion and d (μm) is an average value of level differences between a ventilation pipe interior wall and the surface on the central side at at least one of a connection portion between the expansion portion and the inlet-side ventilation pipe or a connection portion between the expansion portion and the outlet-side ventilation pipe.

[2] The air passage type silencer described in [1], in which the level difference d satisfies Equation (1), Equation (2), and Equation (3) at both of the connection portion between the expansion portion and the inlet-side ventilation pipe and the connection portion between the expansion portion and the outlet-side ventilation pipe.

[3] The air passage type silencer described in [1] or [2], in which a maximum value dmax (μm) of the level difference between the ventilation pipe interior wall and the surface on the central side at at least one of the connection portion between the expansion portion and the inlet-side ventilation pipe or the connection portion between the expansion portion and the outlet-side ventilation pipe satisfies Equation (1), Equation (2), and Equation (3).

[4] The air passage type silencer described in any one of [1] to [3], in which the arithmetic average height Sa is equal to or larger than 5 μm and equal to or smaller than 200 μm.

[5] The air passage type silencer described in any one of [1] to [4], further comprising:

a porous sound absorbing material that is disposed along an inner peripheral surface of the expansion portion, in which the porous sound absorbing material is the surface on the central side in the expansion portion, the arithmetic average height Sa is an arithmetic average height Sa of a surface of the porous sound absorbing material that is on the central side, and the level difference d is a level difference between the ventilation pipe interior wall and the surface of the porous sound absorbing material that is on the central side.

[6] The air passage type silencer described in any one of [1] to [5], in which a flow path between an opening portion of the expansion portion that is on an inlet-side ventilation pipe side and an opening portion of the expansion portion that is on an outlet-side ventilation pipe side has a linear shape.

According to the present invention, it is possible to provide an air passage type silencer that can reduce pressure loss even in a case where the flow rate of a gas flowing in the air passage type silencer is high.

DESCRIPTION OF THE PREFERRED EMBODIMENTS

Hereinafter, the present invention will be specifically described.

Although configuration requirements to be described below may be described based on a representative embodiment of the present invention, the present invention is not limited to such an embodiment.

Note that, in the present specification, a numerical range represented using "to" means a range including numerical values described before and after the preposition "to" as a lower limit value and an upper limit value.

In addition, in the present specification, "perpendicular" and "parallel" include a range of errors accepted in the technical field to which the present invention belongs. For example, "being perpendicular" or "being parallel" means being in a range of less than ±10° or the like with respect to being strictly perpendicular in the strict sense or being parallel in the strict sense and the error with respect to being strictly perpendicular in the strict sense or being parallel in the strict sense is preferably 5° or less, and more preferably 3° or less.

In the present specification, the meanings of "the same", and "identical" may include a range of errors generally accepted in the technical field.

[Air Passage Type Silencer]

An air passage type silencer according to an embodiment of the present invention is an air passage type silencer including:

an inlet-side ventilation pipe;

an expansion portion that communicates with the inlet-side ventilation pipe and of which a cross-sectional area is larger than a cross-sectional area of the inlet-side ventilation pipe; and an outlet-side ventilation pipe that communicates with the expansion portion and of which a cross-sectional area is smaller than the cross-sectional area of the expansion portion, in which a level difference d satisfies Equation (1): $d \geq 100$ μm, satisfies Equation (2): $d \leq 25 \times Sa + 193$ μm in a case where an arithmetic average height Sa is equal to or smaller than 50 μm, and satisfies Equation (3): $d \leq 1450$ μm in a case where the arithmetic average height Sa exceeds 50 μm, where Sa (μm) is an arithmetic average height of a surface on a central side in the expansion portion and d (μm) is an average value of level differences between a ventilation pipe interior wall and the surface on the central side at at least one of a connection portion between the expansion portion and the inlet-side ventilation pipe or a connection portion between the expansion portion and the outlet-side ventilation pipe.

The configuration of the air passage type silencer according to the embodiment of the present invention will be described with reference to the drawings.

Figure 1:
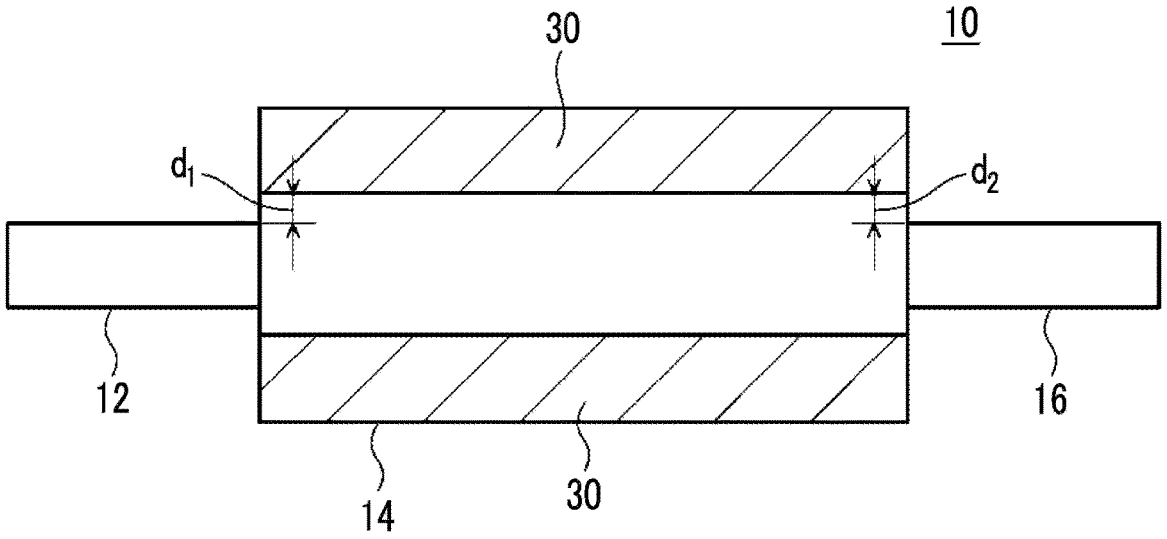
FIG. 1 is a cross-sectional view conceptually showing an example of an air passage type silencer according to an aspect of the present invention.

FIG. 1 is a schematic cross-sectional view showing an example of an embodiment of the air passage type silencer according to the embodiment of the present invention.

As shown in FIG. 1, an air passage type silencer 10 includes a tubular inlet-side ventilation pipe 12, an expansion portion 14 connected to one opening edge surface of the inlet-side ventilation pipe 12, a tubular outlet-side ventilation pipe 16 that is connected to an edge surface of the expansion portion 14 on a side opposite to the inlet-side ventilation pipe 12, and a porous sound absorbing material 30.

The inlet-side ventilation pipe 12 is a tubular member through which a gas that flows into the inlet-side ventilation pipe 12 through one opening edge surface is transported to the expansion portion 14 connected to the other opening edge surface.

The outlet-side ventilation pipe 16 is a tubular member through which a gas that flows into the outlet-side ventilation pipe 16 through one opening edge surface connected to the expansion portion 14 is transported to the other opening edge surface.

The cross-sectional shapes of the inlet-side ventilation pipe 12 and the outlet-side ventilation pipe 16 (hereinafter, collectively referred to as ventilation pipes) may be various shapes such as a circular shape, a rectangular shape, and a triangular shape. In addition, the cross-sectional shape of a ventilation pipe may not be constant in an axial direction along a central axis of the ventilation pipe. For example, the diameter of the ventilation pipe may change in the axial direction.

The inlet-side ventilation pipe 12 and the outlet-side ventilation pipe 16 may have the same cross-sectional shape and cross-sectional area, or may have different shapes and/or cross-sectional areas. In addition, in an example shown in FIG. 1, the inlet-side ventilation pipe 12 and the outlet-side ventilation pipe 16 are disposed such that central axes thereof coincide with each other. However, the present invention is not limited thereto and the central axis of the inlet-side ventilation pipe 12 and the central axis of the outlet-side ventilation pipe 16 may be offset from each other.

The sizes (the cross-sectional areas or the like) of the inlet-side ventilation pipe 12 and the outlet-side ventilation pipe 16 may be set as appropriate in accordance with the size of a device in which the air passage type silencer is used, the required air passage performance, and the like.

The expansion portion 14 is disposed between the inlet-side ventilation pipe 12 and the outlet-side ventilation pipe 16 and transports, to the outlet-side ventilation pipe 16, a gas that flows into the expansion portion 14 from the inlet-side ventilation pipe 12.

The cross-sectional area of the expansion portion 14 that is perpendicular to a flow path direction is larger than the cross-sectional area of the inlet-side ventilation pipe 12 and is larger than the cross-sectional area of the outlet-side ventilation pipe 16. That is, for example, in a case where the cross-sectional shapes of the inlet-side ventilation pipe 12, the outlet-side ventilation pipe 16, and the expansion portion 14 are circular, the diameter of the cross-section of the expansion portion 14 is larger than the diameters of the inlet-side ventilation pipe 12 and the outlet-side ventilation pipe 16.

The cross-sectional shape of the expansion portion 14 may be various shapes such as a circular shape, a rectangular shape, and a triangular shape. In addition, the cross-sectional shape of the expansion portion 14 may not be constant in an axial direction along a central axis of the expansion portion 14. For example, the diameter of the expansion portion 14 may change in the axial direction.

The size (the length, the cross-sectional area, or the like) of the expansion portion 14 may be set as appropriate in accordance with the size of a device in which the air passage type silencer is used, the required sound attenuation performance, and the like.

The porous sound absorbing material 30 is disposed in the expansion portion 14. The porous sound absorbing material 30 is disposed along an inner peripheral surface (an inner wall surface) of the expansion portion 14 to absorb and attenuate a sound. In the example shown in the drawing, the length of the porous sound absorbing material 30 in the flow path direction is approximately equal to the length of the inside of the expansion portion 14 and the porous sound absorbing material 30 is disposed between a side surface of the expansion portion 14 to which the inlet-side ventilation pipe 12 is connected and a side surface of the expansion portion 14 to which the outlet-side ventilation pipe 16 is connected. In addition, the porous sound absorbing material 30 has a tubular shape that is hollow, the outer shape of the porous sound absorbing material 30 is approximately the same as the cross-sectional shape of the inside of the expansion portion 14, and the porous sound absorbing material 30 is disposed along the inner peripheral surface of the expansion portion 14 in a circumferential direction. In addition, a hollow portion of the porous sound absorbing material 30 extends in the flow path direction and is formed over an area from the inlet-side ventilation pipe 12 side of the expansion portion 14 to the outlet-side ventilation pipe 16 side. In addition, the cross-sectional shape of the hollow portion of the porous sound absorbing material 30 is similar to the cross-sectional shapes of the ventilation pipes and the porous sound absorbing material 30 is disposed such that central axes of the porous sound absorbing material 30 and the ventilation pipes coincide with each other. In addition, the size of a cross section of the hollow portion of the porous sound absorbing material 30 is larger than the size of cross sections of the ventilation pipes. That is, as seen in the flow path direction, the porous sound absorbing material 30 is disposed so as not to block the ventilation pipes. Accordingly, the hollow portion of the porous sound absorbing material 30 serves as a ventilation path.

For example, in a case where the expansion portion 14 has a cylindrical shape, the porous sound absorbing material 30 may have a cylindrical shape matching the shape of a peripheral surface of the expansion portion 14. In addition, in a case where the expansion portion 14 has a quadrangular tube-like shape, the porous sound absorbing material 30 may have a quadrangular tube-like shape matching the shape of the peripheral surface of the expansion portion 14.

In addition, for example, in a case where the cross-sectional shapes of the ventilation pipes are circular, the hollow portion of the porous sound absorbing material 30 may have a circular shape. In addition, for example, in a case where the cross-sectional shapes of the ventilation pipes are quadrangular, the hollow portion of the porous sound absorbing material 30 may have a quadrangular shape.

The porous sound absorbing material is not particularly limited, and a sound absorbing material publicly known in the related art can be used as appropriate. For example, various known sound absorbing materials such as a foaming body, a foaming material (foaming urethane foam (for example, CALMFLEX F manufactured by INOAC CORPORATION, urethane foam manufactured by Hikari Co., Ltd., and the like), flexible urethane foam, a ceramic particle sintered material, phenol foam, melamine foam, a polyamide foam, and the like), a nonwoven fabric sound absorbing material (a microfiber nonwoven fabric (for example, Thinsulate manufactured by 3M Company and the like), a polyester nonwoven fabric (for example, White Kyuon manufactured by TOKYO Bouon and QonPET manufactured by Bridgestone KBG Co., Ltd. and such products are provided even in the form of a two-layer configuration with a high-density thin surface nonwoven fabric and a low-density rear surface nonwoven fabric), a plastic nonwoven fabric such as an acrylic fiber nonwoven fabric, a natural fiber nonwoven fabric such as wool and felt, a metal nonwoven fabric, a glass nonwoven fabric, and the like), and a material including a minute amount of air (glass wool, rock wool, and a nanofiber-based fiber sound absorbing material (silica nanofiber and acrylic nanofiber (for example, XAI manufactured by Mitsubishi Chemical Corporation))) can be used.

Here, in the present invention, a level difference d satisfies Equation (1): $d \geq 100$ μm, satisfies Equation (2): $d \leq 25 \times Sa + 193$ μm in a case where an arithmetic average height Sa is equal to or smaller than 50 μm, and satisfies Equation (3): $d \leq 1450$ μm in a case where the arithmetic average height Sa exceeds 50 μm, where Sa (μm) is the arithmetic average height of a surface on a central side in the expansion portion 14 and d (μm) is the average value of level differences between a ventilation pipe interior wall and the surface on the central side at at least one of a connection portion between the expansion portion 14 and the inlet-side ventilation pipe 12 or a connection portion between the expansion portion 14 and the outlet-side ventilation pipe 16.

The surface on the central side in the expansion portion 14 is a surface that is an outermost surface in the expansion portion 14 as seen in the radial direction from a line segment that connects the center of an opening portion of the inlet-side ventilation pipe 12 and the center of an opening portion of the outlet-side ventilation pipe 16 to each other.

In the case of a configuration in which the tubular porous sound absorbing material 30 is disposed in the expansion portion 14 as shown in FIG. 1, the surface on the central side in the expansion portion 14 is a surface of the hollow portion of the porous sound absorbing material 30. Therefore, in the case of the example shown in FIG. 1, the arithmetic average height Sa of the surface on the central side in the expansion portion 14 is the arithmetic average height Sa of the surface of the hollow portion of the porous sound absorbing material 30.

In addition, in the example shown in FIG. 1, the level difference d between the ventilation pipe interior wall and the surface on the central side at the connection portion between the expansion portion 14 and the ventilation pipe is, as shown in FIG. 1, a radial distance $d_1$ between an interior wall of the inlet-side ventilation pipe 12 and the surface of the hollow portion of the porous sound absorbing material 30 and a radial distance $d_2$ between an interior wall of the outlet-side ventilation pipe 16 and the surface of the hollow portion of the porous sound absorbing material 30.

In the present invention, the level difference d at the connection portion between the ventilation pipe and the expansion portion is defined in accordance with the arithmetic average height Sa of the surface on the central side in the expansion portion 14, that is, the surface roughness of a portion of the expansion portion 14 that serves as a ventilation path through which air flows. The present inventors have found that providing the level difference d at the connection portion between the ventilation pipe and the expansion portion in accordance with the arithmetic average height Sa of the surface on the central side in the expansion portion 14 can result in reduction of pressure loss.

Generally, in a case where a fluid flows in a linear tube with no level difference, the fluid cannot move as locally seen in the vicinity of a wall surface and thus a shearing force acts between the vicinity of the wall surface and the fluid flowing at the center, which results in pressure loss. Particularly, in a case where a diameter is small and the wind speed is high, there is great pressure loss. That is, in a case where the diameter of the ventilation pipe is large, pressure loss is small.

Meanwhile, it is known that pressure loss occurs at a stepped portion in a case where there is a level difference in a flow path through which a fluid flows. Generally, pressure loss occurring at the stepped portion exceeds the amount of pressure loss reduction achieved by an increase in diameter. Therefore, it is conceived that total pressure loss is increased in a case where the stepped portion is provided.

Meanwhile, although there is a large level difference at a connection portion between an expansion portion and a ventilation path in an air passage type silencer including the expansion portion, it is conceivable to dispose a porous sound absorbing material in the expansion portion such that the level difference is eliminated and pressure loss caused by the level difference is reduced.

However, since the porous sound absorbing material has a rough surface of which the unevenness is large since the surface has a large number of fine cavities. In a case where a surface roughness is rough, pressure loss attributable to a pipe line itself is great.

Therefore, the present inventors have presumed that, in a case where a surface roughness is large, there is a case where the amount of pressure loss reduction achieved by an increase in diameter becomes large and exceeds pressure loss occurring at a stepped portion with a level difference provided at a connection portion between an expansion portion and a ventilation path and total pressure loss is reduced.

As a result of studying this point in more detail by the present inventors, it has been found that, in a case where the arithmetic average height Sa is equal to or smaller than 50 μm, pressure loss is reduced in comparison with a case where the level difference d is 100 μm in a case where the level difference d satisfies Equation (2): $d \leq 25 \times Sa + 193$ μm.

In addition, it has been found that, in a case where the arithmetic average height Sa exceeds 50 μm, pressure loss is reduced in comparison with a case where the level difference d is 100 μm in a case where the level difference d satisfies Equation (3): $d \leq 1450$ μm.

Figure 2:
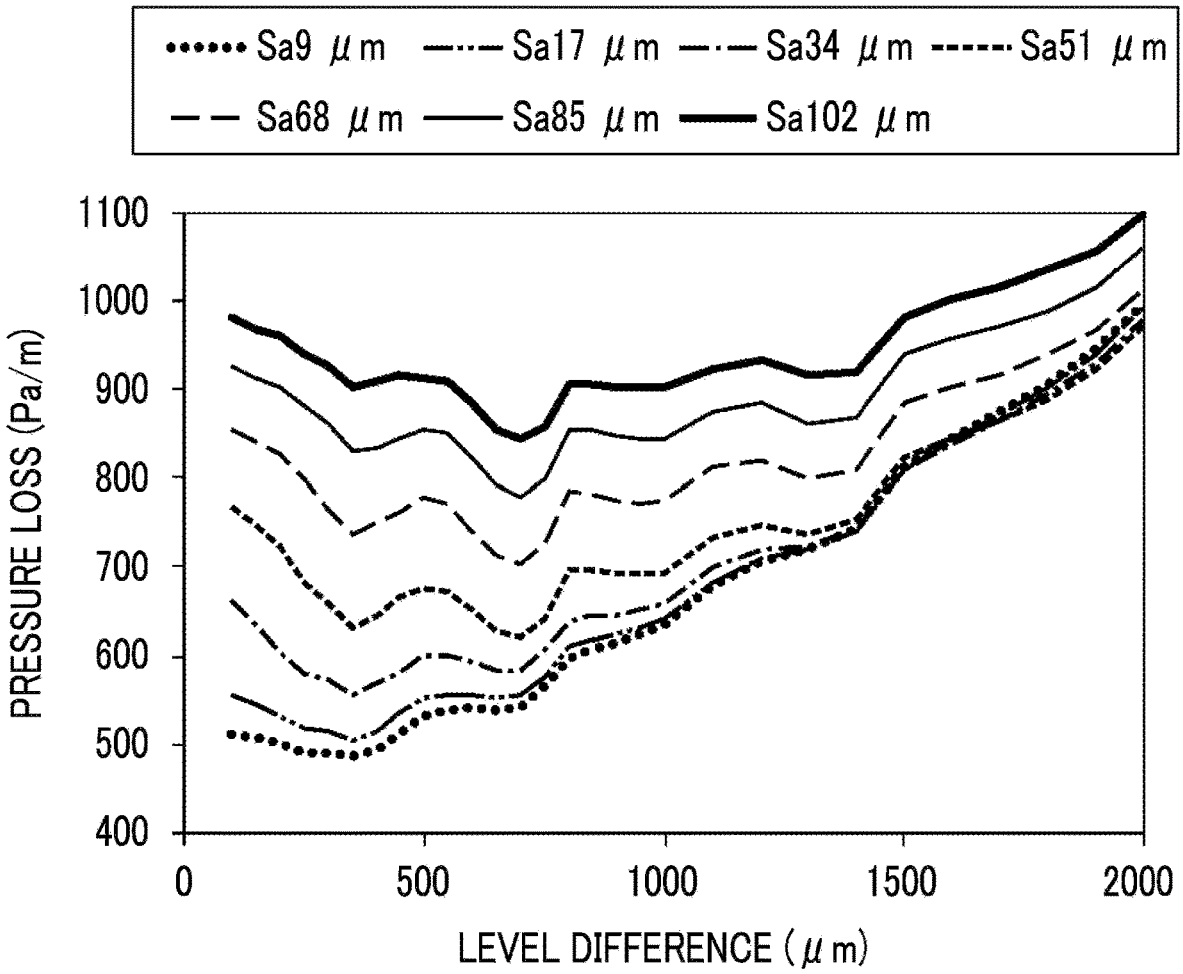
FIG. 2 is a graph showing a relationship between a level difference and pressure loss.
Figure 3:
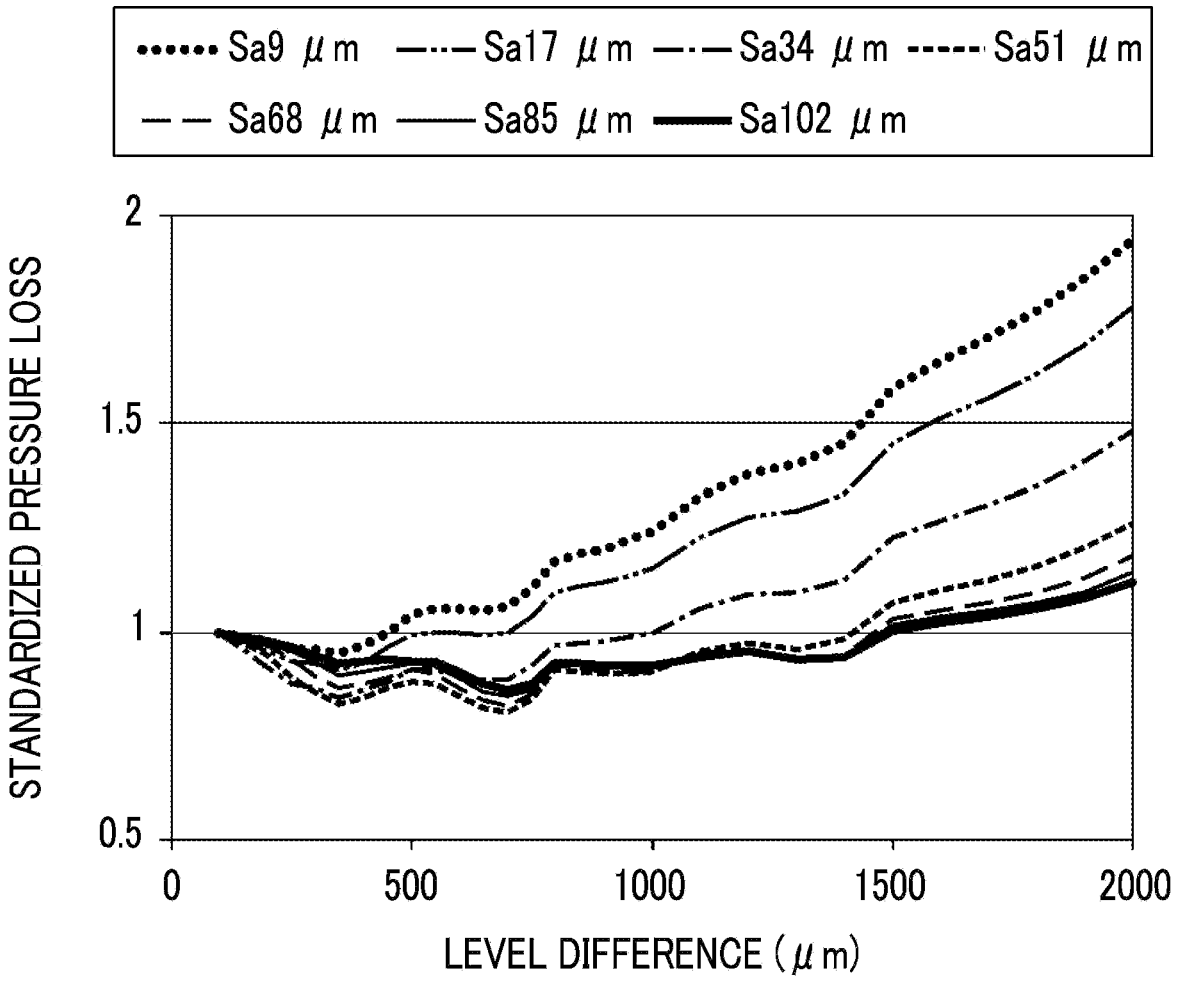
FIG. 3 is a graph showing a relationship between the level difference and standardized pressure loss.

FIG. 2 is a graph showing the result of a simulation in which pressure loss in the case of a change in level difference d was obtained for each of the arithmetic average heights Sa of the surface on the central side in the expansion portion, the arithmetic average heights Sa being 9 μm, 17 μm, 34 μm, 51 μm, 68 μm, 85 μm, and 102 μm. FIG. 3 is a graph showing the result shown in FIG. 2 in which pressure loss is standardized on an assumption that pressure loss occurring in a case where the level difference d is 100 μm is 1.

It can be found from FIGS. 2 and 3 that, in a case where the arithmetic average height Sa falls in a range of 50 μm or less, the larger the arithmetic average height Sa, the wider a range of the level differences d in which pressure loss is reduced in comparison with a case where the level difference d is 100 μm (standardized pressure loss is 1 or less). In addition, it can be found that, in a case where the arithmetic average height Sa falls in a range exceeding 50 μm, a range of the level differences d in which pressure loss is reduced in comparison with a case where the level difference d is 100 μm stays the approximately same even in a case where there is a change in arithmetic average height Sa.

In addition, it can be found that the larger the arithmetic average height Sa, the wider a range of the level differences d in which pressure loss is reduced in comparison with a case where the level difference d is 100 μm although the larger the arithmetic average height Sa, the larger the absolute value of pressure loss.

Figure 4:
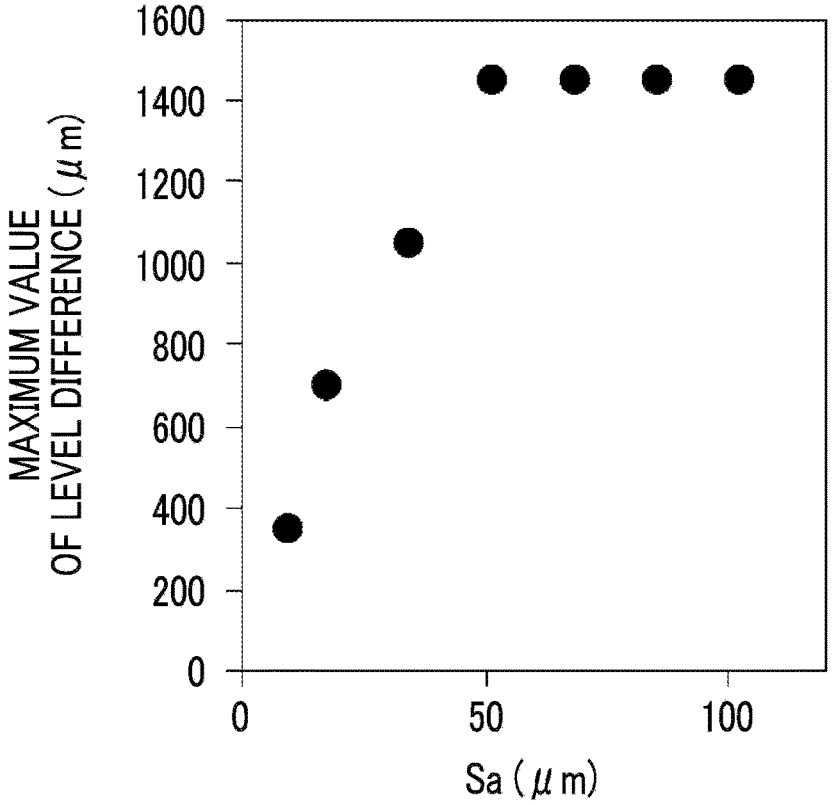
FIG. 4 is a graph showing a relationship between an arithmetic average height Sa and a level difference maximum value.

FIG. 4 is a graph showing a relationship between the arithmetic average height Sa and the maximum value of the level difference d (hereinafter, may be simply referred to as the maximum value of the level difference d) at which pressure loss is reduced in comparison with a case where the level difference d is 100 μm. It can be found that FIG. 4 that, in a case where the arithmetic average height Sa is in a range of 50 μm or less, the maximum value of the level difference d increases in a substantially linear manner with respect to the arithmetic average height Sa. In addition, it can be found that, in a case where the arithmetic average height Sa is in a range exceeding 50 μm, the maximum value of the level difference d is approximately constant even in a case where there is a change in arithmetic average height Sa. According to the graph, the maximum value of the level difference d related to a case where the arithmetic average height Sa is in a range exceeding 50 μm is 1450 μm. Accordingly, in a case where the arithmetic average height Sa exceeds 50 μm, pressure loss is reduced in comparison with a case where the level difference d is 100 μm in a case where the level difference d is in a range satisfying Equation (3): d≤1450 μm.

Figure 5:
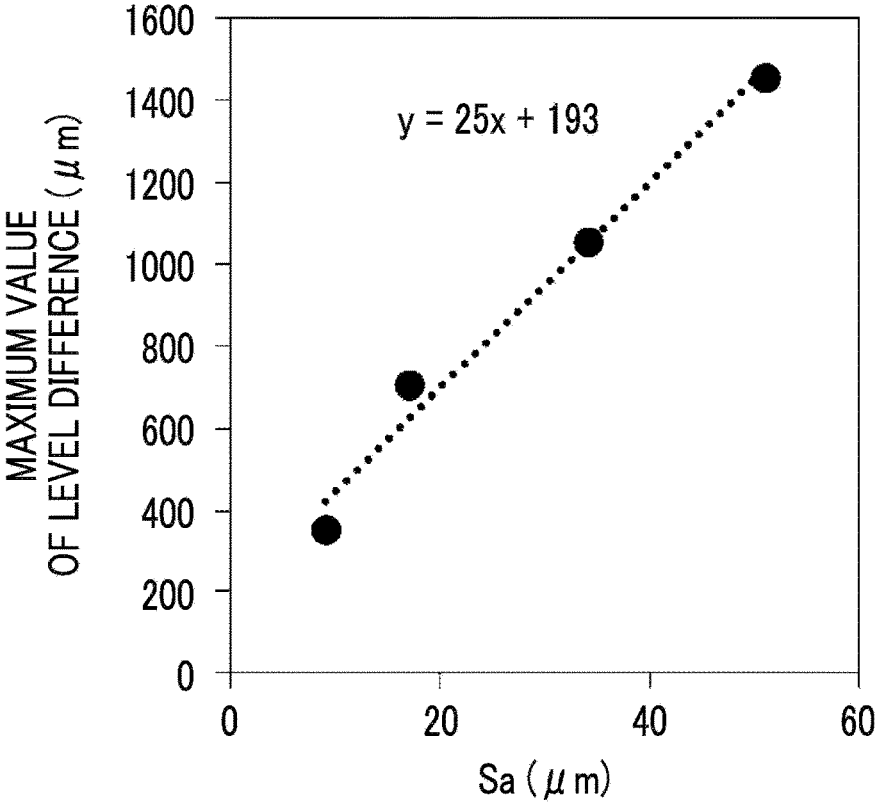
FIG. 5 is a graph showing a relationship between the arithmetic average height Sa and the level difference maximum value.

FIG. 5 is a graph that shows a relationship between the arithmetic average height Sa and the maximum value of the level difference d related to a case where the arithmetic average height Sa is in a range of 50 μm or less and from which an approximation straight line of the relationship between the arithmetic average height Sa and the maximum value of the level difference d is obtained. An approximate straight line d=25×Sa+193 can be obtained from the graph. Therefore, in a case where the arithmetic average height Sa is equal to or smaller than 50 μm, pressure loss is reduced in comparison with a case where the level difference d is 100 μm in a case where the level difference d is in a range satisfying Equation (2): d≤25×Sa+193 μm.

Note that in the simulation, a CFD module (a fluid-dynamics module) of COMSOL MultiPhysics was used to obtain, through calculation, pressure loss in the case of a change in arithmetic average height Sa of the surface on the central side in the expansion portion and level difference d between the ventilation pipe and the connection portion. The conditions were as follows.

The expansion portion had a length of 130 mm and a diameter of 50 mm, and the diameter of the ventilation pipe was 28 mm.

In the expansion portion, porous sound absorbing materials having surface roughnesses, of which the arithmetic average heights Sa were 9, 17, 34, 51, 68, 85, and 102 μm, were disposed. The diameter of a hollow portion of each porous sound absorbing material was set in accordance with the level difference d.

The level difference d was calculated from 100 μm to 2000 μm in increments of 50 μm.

The wind speed of wind flowing into the expansion portion was 30 m/s.

The arithmetic average height Sa of the surface on the central side in the expansion portion is a surface roughness and can be measured and defined according to ISO 25178. Specifically, the measurement can be performed using a laser microscope (for example, VK-X3000 Series manufactured by KEYENCE CORPORATION). The arithmetic average height Sa is obtained by measuring a surface height distribution five times with the laser microscope while performing the measurement for a square range having a size of 300 μm×300 μm and changing the position of measurement for each time the measurement is performed and calculating the average thereof. Even in a case where a laser microscope without the definition of Sa measurement is used, the arithmetic average height Sa can be obtained according to ISO 25178 as long as a height distribution can be acquired by means of the laser microscope.

In addition, in the case of a porous sound absorbing material, there is an area where nothing is present in a measurement range in a case where the density of the porous sound absorbing material is low. Therefore, measurement conditions need to be prescribed. A scanning range of the laser microscope is set to have a height of 1 mm, and measurement is performed such that an area where nothing is present is excluded from the target of calculation. In addition, in a case where the density is very low and the measurement range includes almost no fibers and there are a large number of areas where nothing is present, the measurement is performed for a range wider than 300 μm.

The level difference d at a connection portion between a ventilation pipe and the expansion portion is calculated as follows.

Measurement is performed over the connection portion between the ventilation pipe and the expansion portion by using a laser microscope so that a level difference is measured in a non-contact manner. In a case where a surface roughness is large, a range of 1 mm in the flow path direction is measured by using the laser microscope and a difference between the average position (the position of an arithmetic average height) of heights on a ventilation pipe side and the average position of heights on an expansion portion side is used as a level difference between the ventilation pipe side and the expansion portion side. Such measurement is performed at five points at equal intervals in the circumferential direction, and the average value is used as the level difference d.

Note that although at least one of a level difference $d_1$ at the connection portion between the inlet-side ventilation pipe 12 and the expansion portion 14 or a level difference $d_2$ at the connection portion between the outlet-side ventilation pipe 16 and the expansion portion 14 may satisfy Equations (1) to (3) described above, it is preferable that both the level differences $d_1$ and $d_2$ satisfy Equations (1) to (3) described above.

In addition, it is preferable that all of the level differences d measured for five points at the connection portion between the inlet-side ventilation pipe 12 and the expansion portion 14 and/or all of the level differences d measured for five points at the connection portion between the outlet-side ventilation pipe 16 and the expansion portion 14 satisfy Equations (1) to (3) described above. That is, it is preferable that a maximum value dmax of the level difference between the ventilation pipe interior wall and the surface on the central side satisfies Equations (1) to (3) described above.

In addition, from the viewpoint of being capable of more suitably reducing total pressure loss, it is preferable that the level difference d satisfies Equation (4): 150≤d≤350 μm in a case where the arithmetic average height Sa is equal to or smaller than 50 μm and it is more preferable that the level difference d satisfies Equation (5): 150≤d≤1000 μm in a case where the arithmetic average height Sa exceeds 50 μm.

In addition, it is preferable that the arithmetic average height Sa of the surface on the central side in the expansion portion is equal to or larger than 5 μm and equal to or smaller than 200 μm.

In a case where the arithmetic average height Sa of the surface on the central side in the expansion portion is in a range of less than 5 μm, the amount of pressure loss reduction achieved by an increase in diameter does not become large and a range in which pressure loss occurring at a stepped portion is exceeded and total pressure loss is decreased is small. Meanwhile, in a case where the arithmetic average height Sa is in a range exceeding 200 μm, the absolute value of pressure loss is large.

Therefore, in a case where the arithmetic average height Sa of the surface on the central side in the expansion portion is set to be equal to or larger than 5 μm and equal to or smaller than 200 μm, it is possible to more suitably reduce total pressure loss.

In addition, in the example shown in FIG. 1, a flow path between an opening portion of the expansion portion 14 that is on the inlet-side ventilation pipe 12 side and an opening portion of the expansion portion 14 that is on the outlet-side ventilation pipe 16 side has a linear shape, that is, the hollow portion of the porous sound absorbing material 30 has a straight tubular shape. However, the present invention is not limited thereto. For example, the flow path between the opening portion of the expansion portion 14 that is on the inlet-side ventilation pipe 12 side and the opening portion of the expansion portion 14 that is on the outlet-side ventilation pipe 16 may have a curved tubular shape that is bent.

Pressure loss caused by a level difference at a connection portion between the expansion portion and a ventilation pipe becomes larger in a case where the wind speed of flowing air is high. Therefore, with the air passage type silencer according to the embodiment of the present invention, it is possible to more suitably suppress pressure loss in a case where the wind speed of air flowing in the air passage type silencer is high. Meanwhile, in a case where the wind speed is too high, the amount of generation of a wind noise is made large and it is desirable to reduce the wind speed by widening the ventilation pipes or the like. From the above-described viewpoint, a wind speed in the inlet-side ventilation pipe is preferably equal to or higher than 5 m/s, more preferably 10 m/s to 50 m/s, and still more preferably 15 m/s to 40 m/s.

Figure 8:
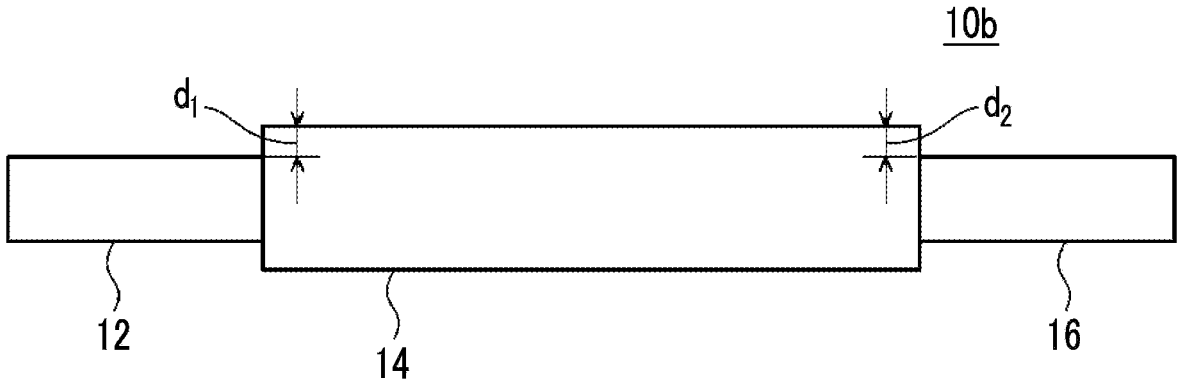
FIG. 8 is a cross-sectional view conceptually showing another example of the air passage type silencer according to the aspect of the present invention.

In addition, in the example shown in FIG. 1, the porous sound absorbing material 30 is in the expansion portion 14. However, the present invention is not limited thereto. FIG. 8 conceptually shows another example of the air passage type silencer according to the embodiment of the present invention.

As shown in FIG. 8, an air passage type silencer 10*b* includes the tubular inlet-side ventilation pipe 12, the expansion portion 14 connected to one opening edge surface of the inlet-side ventilation pipe 12, and the tubular outlet-side ventilation pipe 16 that is connected to an edge surface of the expansion portion 14 on a side opposite to the inlet-side ventilation pipe 12, and the air passage type silencer 10*b* does not include the porous sound absorbing material 30.

The inlet-side ventilation pipe 12, the expansion portion 14, and the outlet-side ventilation pipe 16 have the same configurations as the inlet-side ventilation pipe 12, the expansion portion 14, and the outlet-side ventilation pipe 16 of the air passage type silencer 10 shown in FIG. 1.

In the case of a configuration in which the tubular porous sound absorbing material 30 is not provided as in the case of the air passage type silencer 10*b* shown in FIG. 8, the surface on the central side in the expansion portion 14 is the inner peripheral surface of the expansion portion 14.

Therefore, in the case of the example shown in FIG. 8, the arithmetic average height Sa of the surface on the central side in the expansion portion 14 is the arithmetic average height Sa of the inner peripheral surface of the expansion portion 14.

In addition, in the example shown in FIG. 8, the level difference d between the ventilation pipe interior wall and the surface on the central side at the connection portion between the expansion portion 14 and the ventilation pipe is, as shown in FIG. 8, the radial distance $d_1$ between the interior wall of the inlet-side ventilation pipe 12 and the inner peripheral surface of the expansion portion 14 and the radial distance $d_2$ between the interior wall of the outlet-side ventilation pipe 16 and the inner peripheral surface of the expansion portion 14.

Therefore, in the case of a configuration in which the tubular porous sound absorbing material 30 is not provided as in the example shown in FIG. 8, the level difference d between the interior wall of the ventilation pipe and the inner peripheral surface of the expansion portion 14 satisfies Equation (2): $d \leq 25 \times Sa + 193$ μm in a case where the arithmetic average height Sa of the inner peripheral surface of the expansion portion 14 is equal to or smaller than 50 μm and the level difference d between the interior wall of the ventilation pipe and the inner peripheral surface of the expansion portion 14 satisfies Equation (3): $d \leq 1450$ μm in a case where the arithmetic average height Sa of the inner peripheral surface of the expansion portion 14 exceeds 50 μm.

Accordingly, pressure loss can be reduced.

In addition, in the air passage type silencer according to the embodiment of the present invention, perforated metal may be disposed on a surface of the hollow portion of the porous sound absorbing material.

Examples of the materials of the ventilation pipe and the expansion portion include a metal material, a resin material, a reinforced plastic material, and a carbon fiber. Examples of the metal material include metal materials such as aluminum, titanium, magnesium, tungsten, iron, steel, chromium, chromium molybdenum, nichrome molybdenum, and alloys thereof. Examples of the resin material include resin materials such as acrylic resin (PMMA), polymethyl methacrylate, polycarbonate, polyamide, polyalylate, polyetherimide, polyacetal, polyetheretherketone, polyphenylene sulfide, polysulfone, polyethylene terephthalate, polybutylene terephthalate (PET), polyimide, triacetylcellulose (TAC), polypropylene (PP), polyethylene (PE), polystyrene (PS), ABS resin (copolymer synthetic resin of acrylonitrile, butadiene, and styrene), flame-retardant ABS resin, ASA resin (copolymer synthetic resin of acrylonitrile, styrene, and acrylate), polyvinyl chloride (PVC) resin, and polylactic acid (PLA) resin. In addition, examples of the reinforced plastic material include carbon fiber reinforced plastics (CFRP) and glass fiber reinforced plastics (GFRP).

From the viewpoint of weight reduction, easy molding, and the like, it is preferable to use a resin material as the material of the air passage type silencer. In addition, as described above, from the viewpoint of low-frequency range sound insulation, it is preferable to use a material having a high stiffness. From the viewpoint of weight reduction and sound insulation, the density of a member constituting the air passage type silencer is preferably 0.5 g/cm$^3$ to 2.5 g/cm$^3$.

It is desirable that these materials are non-flammable, flame-retardant, and self-extinguishing. In addition, it is also desirable that the entire air passage type silencer is non-flammable, flame-retardant, and self-extinguishing.

EXAMPLES

Hereinafter, the present invention will be more specifically described based on examples. Materials, used amounts, ratios, treatment contents, treatment procedures, and the like described in the following examples can be appropriately changed without departing from the spirit of the present invention. Therefore, the scope of the present invention should not be construed as being limited to Examples shown below.

Examples 1 to 4 and Comparative Examples 1 and 2

Expansion portions were formed of ABS resin by using a 3D printer (manufactured by XYZ printing, Inc.). Each expansion portion had a cylindrical shape having an inner diameter of 50 mm and a length of 130 mm. The thickness of the ABS resin was 2 mm. In addition, holes having a diameter of 32 mm were formed on both side surfaces of the expansion portion as introduction portions for hoses (ventilation pipes), and hoses having an inner diameter of 28 mm and a thickness of 2 mm were connected as an inlet-side ventilation pipe and an outlet-side ventilation pipe.

In the expansion portions, porous sound absorbing materials (QonPET manufactured by Bridgestone KBG Co., Ltd.) were disposed along an interior wall. Each porous sound absorbing material had a laminated structure with a thin nonwoven fabric having a high fiber density and a nonwoven fabric layer having a low density. The porous sound absorbing material was disposed in a cylindrical shape such that a surface of the thin nonwoven fabric having a high density is positioned on the central side of the expansion portion.

Sa was 18.1 μm in measurement in which the arithmetic average height Sa on a high-density thin nonwoven fabric side was measured by using the above-described method. Although the measurement was performed 5 times with a change in measurement position (measurement target range), the value was stable while being within a range of 17.9 μm to 18.3 μm.

Regarding the thickness of the porous sound absorbing materials, each porous sound absorbing material was disposed in an expansion portion after being processed by using a laser cutter (processing accuracy: 0.1 μm) such that the level differences d between a ventilation pipe interior wall and a surface on a central side at a connection portion between the expansion portion and a ventilation pipe became 100 μm, 300 μm, 500 μm, 600 μm, 800 μm, and 900 μm, respectively. After the porous sound absorbing materials were disposed in the expansion portions, the level differences D were measured by using the above-described method and it was confirmed in the measurement that the level differences were as set as described above.

Since the arithmetic average height Sa was equal to or smaller than 50 μm, d obtained from Equation (2) in the case of the arithmetic average height Sa=18.1 μm was 645.5 μm. That is, cases where the level differences d are 100 μm, 300 μm, 500 μm, and 600 μm, respectively, correspond to Examples of the present invention.

Air was caused to flow into an inlet-side ventilation pipe side by using a fan. The wind speed of wind flowing into the inlet-side ventilation pipes was 30 m/s. Since the inlet-side ventilation pipes were 0.028 m, the amount of wind was 0.0185 $m^3$/s.

By using a differential pressure gauge "testo 510" manufactured by Testo SE & Co. KGaA, a static pressure was measured at positions 20 mm separated from connection portions to the inlet-side ventilation pipes and positions 20 mm separated from connection portions to the outlet-side ventilation pipes. In a case where a calibrated differential pressure gauge or pressure gauge was used, the pressure loss was measured by dividing a difference between a static pressure on an inlet side and a static pressure on an outlet side by the length of the expansion portions.

Figure 6:
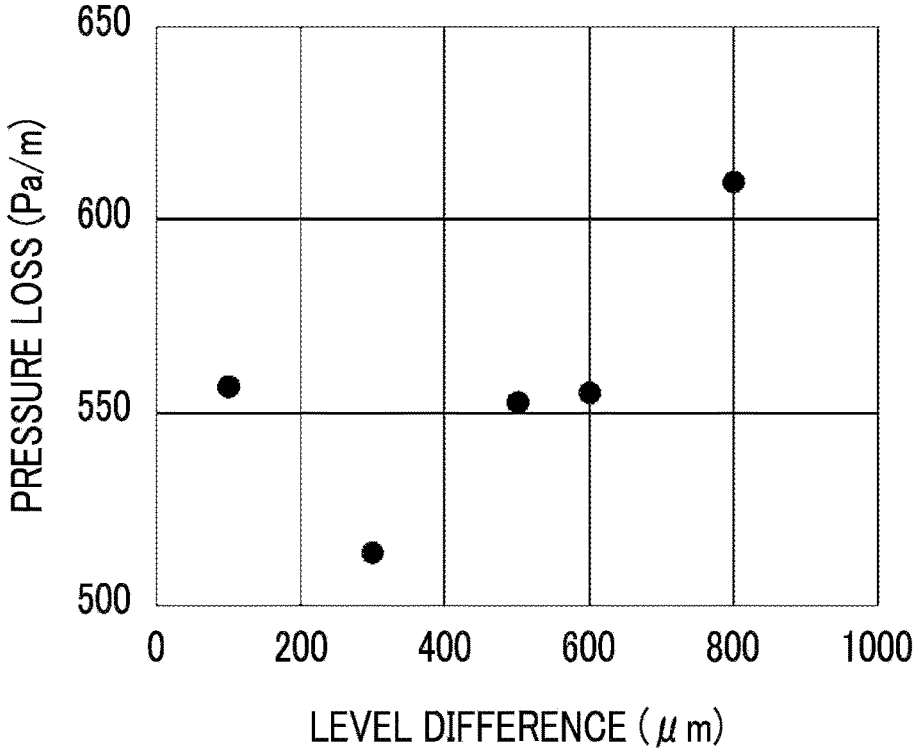
FIG. 6 is a graph showing a relationship between a level difference and pressure loss.

The result is shown in FIG. 6.

As shown in a graph in FIG. 6, in a case where a case where the level difference d is 100 μm (Example 1) is used as a standard, the level difference d of 300 μm (Example 2), the level difference d of 500 μm (Example 3), and the level difference d of 600 μm (Example 4) result in pressure loss smaller than pressure loss in Example 1. Meanwhile, the level difference d of 800 μm (Comparative Example 1) and the level difference d of 900 μm (Comparative Example 2) result in pressure loss larger than the pressure loss in Example 1.

That is, it can be found that, in a case where the arithmetic average height Sa is equal to or smaller than 50 μm, Examples 2 to 4 in which Equation (2): $d \leq 25 \times Sa + 193$ μm is satisfied result in pressure loss smaller than pressure loss in the case of d=100 μm and Comparative Examples 1 and 2 in which d does not satisfy Equation (2) result in pressure loss larger than pressure loss in the case of d=100 μm.

In addition, it can be found that such a result coincides well with the case of Sa=17 μm in the simulation shown in FIG. 2.

Examples 5 to 12 and Comparative Example 3

Air passage type silencers were manufactured in the same manner as Example 1 except that porous sound absorbing materials (QonPET manufactured by Bridgestone KBG Co., Ltd.) were disposed such that surfaces of nonwoven fabrics having a low density are positioned on the central sides of expansion portions and the thicknesses of the porous sound absorbing materials were changed such that the level differences d become 100 μm, 300 μm, 500 μm, 700 μm, 900 μm, 1100 μm, 1300 μm, 1400 μm, and 1500 μm, respectively.

Sa was 51 μm in measurement in which the arithmetic average height Sa of a surface on a low-density nonwoven fabric side was measured by using the above-described method. Although the measurement was performed 5 times with a change in measurement position (measurement target range), the results were within a range of 46 μm to 55 μm.

Since the arithmetic average height Sa is equal to or larger than 50 μm, the level difference d is equal to or smaller than 1450 μm according to Expression (3). That is, cases where the level differences d are 100 μm, 300 μm, 500 μm, 700 μm, 900 μm, 1100 μm, 1300 μm, and 1400 μm correspond to Examples of the present invention.

For each of Examples and each of Comparative Examples, pressure loss was measured in the same manner as in Example 1. The result is shown in FIG. 7.

Figure 7:
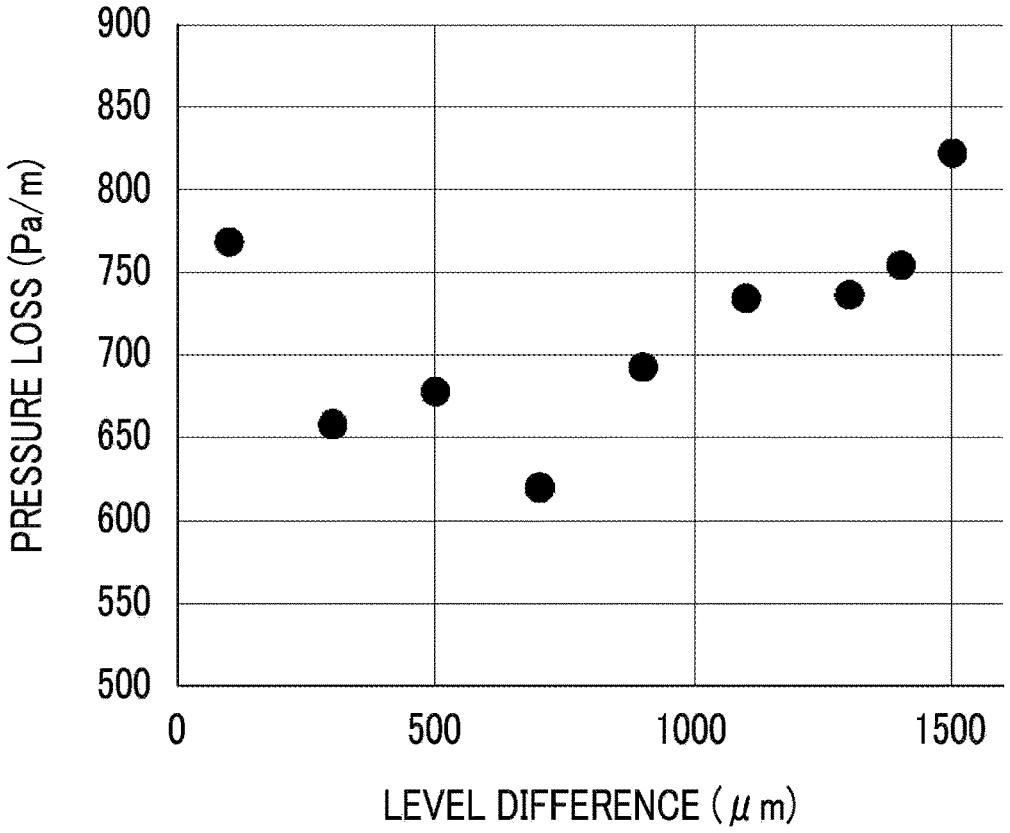
FIG. 7 is a graph showing a relationship between the level difference and pressure loss.

As shown in a graph in FIG. 7, in a case where a case where the level difference d is 100 μm (Example 5) is used as a standard, the level difference d of 300 μm (Example 6) to 1400 μm (Example 12) results in pressure loss smaller than pressure loss in Example 4. Meanwhile, the level difference d of 1500 μm (Comparative Example 3) results in pressure loss larger than the pressure loss in Example 1.

That is, it can be found that, in a case where the arithmetic average height Sa is equal to or larger than 50 μm, Examples 6 to 12 in which Equation (3): $d \leq 1450$ μm is satisfied result in pressure loss smaller than pressure loss in the case of d=100 μm and Comparative Example 3 in which d does not satisfy Equation (3) result in pressure loss larger than pressure loss in the case of d=100 μm.

In addition, it can be found that such a result coincides well with the case of Sa=51 μm in the simulation shown in FIG. 2.

Examples 13 to 17 and Comparative Examples 4 and 5

Porous sound absorbing materials (QonPET manufactured by Bridgestone KBG Co., Ltd.) were pressed and crushed from surfaces of nonwoven fabrics having a low density and a crushed state was maintained for about one day to make the densities thereof high and to adjust the arithmetic average heights Sa to become small. Sa was 34 μm in measurement in which the arithmetic average height Sa was measured by using the above-described method.

Air passage type silencers were manufactured in the same manner as Example 1 except that the porous sound absorbing materials were disposed such that such surfaces are positioned on the central sides of expansion portions and the thicknesses of the porous sound absorbing materials were changed such that the level differences d become 100 μm, 300 μm, 500 μm, 800 μm, 900 μm, 1100 μm, and 1500 μm, respectively.

Since the arithmetic average height Sa was equal to or smaller than 50 μm, d obtained from Equation (2) in the case of the arithmetic average height Sa=34 μm was 1043 μm. That is, cases where the level differences d are 100 μm, 300 μm, 500 μm, 800 μm, and 900 μm, respectively, correspond to Examples of the present invention.

Figure 9:
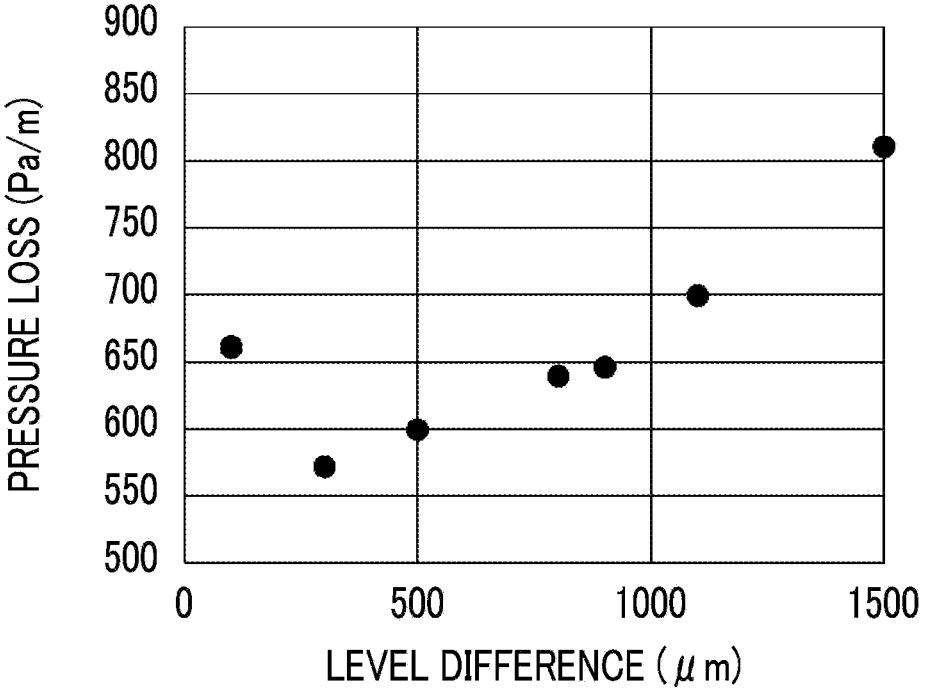
FIG. 9 is a graph showing a relationship between the level difference and pressure loss.

The result is shown in FIG. 9.

As shown in a graph in FIG. 9, in a case where a case where the level difference d is 100 μm (Example 13) is used as a standard, the level difference d of 300 μm (Example 14) to 900 μm (Example 17) results in pressure loss smaller than pressure loss in Example 13. Meanwhile, the level difference d of 1100 μm (Comparative Example 4) and the level difference d of 1500 μm (Comparative Example 5) result in pressure loss larger than the pressure loss in Example 13.

That is, it can be found that, in a case where the arithmetic average height Sa is equal to or smaller than 50 μm, Examples 14 to 17 in which Equation (2): $d \leq 25 \times Sa + 193$ μm is satisfied result in pressure loss smaller than pressure loss in the case of d=100 μm and Comparative Examples 4 and 5 in which d does not satisfy Equation (2) result in pressure loss larger than pressure loss in the case of d=100 μm.

In addition, it can be found that such a result coincides well with the case of Sa=34 μm in the simulation shown in FIG. 2.

Examples 18 to 23 and Comparative Example 6

Porous sound absorbing materials (QonPET manufactured by Bridgestone KBG Co., Ltd.) were stretched out from a side of surfaces of nonwoven fabrics having a low density and such a state was maintained for about one day to make the densities thereof low and to adjust the arithmetic average heights Sa to become large. Sa was 68 μm in measurement in which the arithmetic average height Sa was measured by using the above-described method.

Air passage type silencers were manufactured in the same manner as Example 1 except that the porous sound absorbing materials were disposed such that such surfaces are positioned on the central sides of expansion portions and the thicknesses of the porous sound absorbing materials were changed such that the level differences d become 100 μm, 300 μm, 500 μm, 700 μm, 1000 μm, 1400 μm, and 1500 μm, respectively.

Since the arithmetic average height Sa is equal to or smaller than 50 μm, the level difference d is equal to or smaller than 1450 μm according to Expression (3). That is, cases where the level differences d are 100 μm, 300 μm, 500 μm, 700 μm, 1000 μm, and 1400 μm, respectively, correspond to Examples of the present invention.

Figure 10:
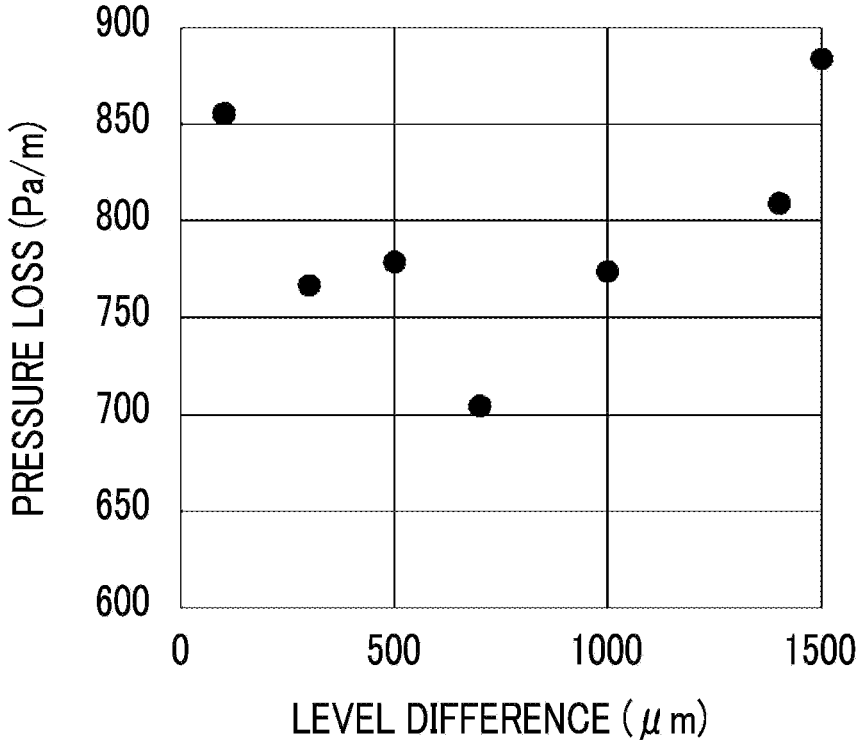
FIG. 10 is a graph showing a relationship between the level difference and pressure loss.

The result is shown in FIG. 10.

As shown in a graph in FIG. 10, in a case where a case where the level difference d is 100 μm (Example 18) is used as a standard, the level difference d of 300 μm (Example 19) to 1400 μm (Example 23) results in pressure loss smaller than pressure loss in Example 18. Meanwhile, the level difference d of 1500 μm (Comparative Example 6) results in pressure loss larger than the pressure loss in Example 18.

That is, it can be found that, in a case where the arithmetic average height Sa exceeds 50 μm, Examples 19 to 23 in which Equation (3): $d \leq 1450$ μm is satisfied result in pressure loss smaller than pressure loss in the case of d=100 μm and Comparative Example 6 in which d does not satisfy Equation (3) result in pressure loss larger than pressure loss in the case of d=100 μm.

In addition, it can be found that such a result coincides well with the case of Sa=68 μm in the simulation shown in FIG. 2.

In addition, it can be found from the above-described results related to the arithmetic average heights Sa of 18.1 μm, 34 μm, 51 μm, and 68 μm that the level difference d satisfying Equation (2): $d \leq 25 \times Sa + 193$ μm can result in reduction in pressure loss in a case where the arithmetic average height Sa is equal to or smaller than 50 μm and the level difference d satisfying Equation (3): $d \leq 1450$ μm can result in reduction in pressure loss in a case where the arithmetic average height Sa exceeds 50 μm.

As understood from the above results, the effect of the present invention is obvious.

EXPLANATION OF REFERENCES

10: air passage type silencer
12: inlet-side ventilation pipe
14: expansion portion
16: outlet-side ventilation pipe
30: porous sound absorbing material

What is claimed is:

1. An air passage type silencer comprising:

an inlet-side ventilation pipe;

an expansion portion that communicates with the inlet-side ventilation pipe and of which a cross-sectional area is larger than a cross-sectional area of the inlet-side ventilation pipe; and an outlet-side ventilation pipe that communicates with the expansion portion and of which a cross-sectional area is smaller than the cross-sectional area of the expansion portion, wherein one opening edge surface of the inlet-side ventilation pipe and one side surface of the expansion portion are connected to each other, and one opening edge surface of the outlet-side ventilation pipe and another side surface of the expansion portion are connected to each other, a level difference d satisfies Equation (1): $d \geq 100$ μm, satisfies Equation (2): $d \leq 25 \times Sa + 193$ μm in a case where an arithmetic average height Sa is equal to or smaller than 50 μm, and satisfies Equation (3): $d \leq 1450$ μm in a case where the arithmetic average height Sa exceeds 50 μm, where Sa (μm) is an arithmetic average height of a surface on a central side in the expansion portion and d (μm) is an average value of level differences between a ventilation pipe interior wall and the surface on the central side at at least one of a connection portion between the expansion portion and the inlet-side ventilation pipe or a connection portion between the expansion portion and the outlet-side ventilation pipe.

2. The air passage type silencer according to claim 1, wherein the level difference d satisfies Equation (1), Equation (2), and Equation (3) at both of the connection portion between the expansion portion and the inlet-side ventilation pipe and the connection portion between the expansion portion and the outlet-side ventilation pipe.

3. The air passage type silencer according to claim 1, wherein a maximum value dmax (μm) of the level difference between the ventilation pipe interior wall and the surface on the central side at at least one of the connection portion between the expansion portion and the inlet-side ventilation pipe or the connection portion between the expansion portion and the outlet-side ventilation pipe satisfies Equation (1), Equation (2), and Equation (3).

4. The air passage type silencer according to claim 1, wherein the arithmetic average height Sa is equal to or larger than 5 μm and equal to or smaller than 200 μm.

5. The air passage type silencer according to claim 1, further comprising:

a porous sound absorbing material that is disposed along an inner peripheral surface of the expansion portion, wherein the porous sound absorbing material is the surface on the central side in the expansion portion, the arithmetic average height Sa is an arithmetic average height Sa of a surface of the porous sound absorbing material that is on the central side, and the level difference d is a level difference between the ventilation pipe interior wall and the surface of the porous sound absorbing material that is on the central side.

6. The air passage type silencer according to claim 1, wherein a flow path between an opening portion of the expansion portion that is on an inlet-side ventilation pipe side and an opening portion of the expansion portion that is on an outlet-side ventilation pipe side has a linear shape.

7. The air passage type silencer according to claim 2, wherein a maximum value dmax (μm) of the level difference between the ventilation pipe interior wall and the surface on the central side at at least one of the connection portion between the expansion portion and the inlet-side ventilation pipe or the connection portion between the expansion portion and the outlet-side ventilation pipe satisfies Equation (1), Equation (2), and Equation (3).

8. The air passage type silencer according to claim 2, wherein the arithmetic average height Sa is equal to or larger than 5 μm and equal to or smaller than 200 μm.

9. The air passage type silencer according to claim 2, further comprising:

a porous sound absorbing material that is disposed along an inner peripheral surface of the expansion portion, wherein the porous sound absorbing material is the surface on the central side in the expansion portion, the arithmetic average height Sa is an arithmetic average height Sa of a surface of the porous sound absorbing material that is on the central side, and the level difference d is a level difference between the ventilation pipe interior wall and the surface of the porous sound absorbing material that is on the central side.

10. The air passage type silencer according to claim 2, wherein a flow path between an opening portion of the expansion portion that is on an inlet-side ventilation pipe side and an opening portion of the expansion portion that is on an outlet-side ventilation pipe side has a linear shape.

11. The air passage type silencer according to claim 3, wherein the arithmetic average height Sa is equal to or larger than 5 μm and equal to or smaller than 200 μm.

12. The air passage type silencer according to claim 3, further comprising:

a porous sound absorbing material that is disposed along an inner peripheral surface of the expansion portion, wherein the porous sound absorbing material is the surface on the central side in the expansion portion, the arithmetic average height Sa is an arithmetic average height Sa of a surface of the porous sound absorbing material that is on the central side, and the level difference d is a level difference between the ventilation pipe interior wall and the surface of the porous sound absorbing material that is on the central side.

13. The air passage type silencer according to claim 3, wherein a flow path between an opening portion of the expansion portion that is on an inlet-side ventilation pipe side and an opening portion of the expansion portion that is on an outlet-side ventilation pipe side has a linear shape.

14. The air passage type silencer according to claim 4, further comprising:

a porous sound absorbing material that is disposed along an inner peripheral surface of the expansion portion, wherein the porous sound absorbing material is the surface on the central side in the expansion portion, the arithmetic average height Sa is an arithmetic average height Sa of a surface of the porous sound absorbing material that is on the central side, and the level difference d is a level difference between the ventilation pipe interior wall and the surface of the porous sound absorbing material that is on the central side.

15. The air passage type silencer according to claim 4, wherein a flow path between an opening portion of the expansion portion that is on an inlet-side ventilation pipe side and an opening portion of the expansion portion that is on an outlet-side ventilation pipe side has a linear shape.

16. The air passage type silencer according to claim 5, wherein a flow path between an opening portion of the expansion portion that is on an inlet-side ventilation pipe side and an opening portion of the expansion portion that is on an outlet-side ventilation pipe side has a linear shape.

* * * * *